United States Patent [19]

Zafiroglu

[11] Patent Number: 4,876,128

[45] Date of Patent: Oct. 24, 1989

[54] STITCHBONDED NONWOVEN FABRIC

[75] Inventor: Dimitri P. Zafiroglu, Wilmington, Del.

[73] Assignee: E. I. Du Pont de Nemours and Company, Wilmington, Del.

[21] Appl. No.: 331,136

[22] Filed: Mar. 31, 1989

[51] Int. Cl.[4] ..... B32B 3/06

[52] U.S. Cl. ..... 428/102; 28/112; 28/167; 66/192; 428/288; 428/920

[58] Field of Search ..... 428/102, 920, 288; 66/192; 28/112, 167

[56] References Cited

U.S. PATENT DOCUMENTS

| | | | |
|---|---|---|---|
| 4,704,321 | 11/1987 | Zafiroglu | 428/230 |
| 4,737,394 | 4/1988 | Zafiroglu | 428/102 |
| 4,773,328 | 9/1988 | Zafiroglu | 66/192 |

*Primary Examiner*—James J. Bell

[57] ABSTRACT

A stitchbonded fabric with excellent insulating and stretchability characteristics and good laundering durability formed from a bonded fibrous layer stitchbonded with elastic thread under tension, which is then subjected to a relaxed shrinkage treatment to increase its thickness and volume.

6 Claims, No Drawings

STITCHBONDED NONWOVEN FABRIC

BACKGROUND OF THE INVENTION

1. Field of the Invention

The present invention concerns a lightweight, insulating, stitch bonded nonwoven fabric and a process for making it.

2. Description of the Prior Art

Stitchbonded fabrics, made on multi-needle stitching machines, are known in the art. Three of my earlier patents, U.S. Pat. Nos. 4,704,321, 4,737,394 and 4,773,238, disclose a variety of such fabrics, wherein the stitch-bonding preferably is performed with an elastic stitching thread and a "substantially nonbonded" fibrous material.

U.S. Pat. No. 4,704,321 discloses multi-needle stitching a substantially nonbonded fibrous layer of polyethylene plexifilamentary film-fibril strands with elastic thread under tension and then releasing the tension to cause the fibrous layer to contract or pucker. Spandex elastomeric yarns, which can elongate and retract in the range of 100 to 250%, are preferred for the stitching thread. Stitching threads of heat shrinkable yarns, textured yarns, stretch yarns of polyester or nylon, among others, also are disclosed. The latter yarns are said to function in a similar manner to spandex yarns but with considerably less elongation and contraction. The stitchbonded product preferably has a final contracted area that is in the range of 70 to 35% of the original area of the fibrous layer and is particularly suited for use as a wipe-cloth.

U.S. Pat. No. 4,737,394 discloses the stitchbonding of a fibrous polyolefin layer, preferably with a spandex thread (as in U.S. Pat. No. 4,704,321) to form the outer porous fabric of an oil-absorbing article.

U.S. Pat. No. 4,773,238 discloses stitchbonding of a substantially nonbonded layer of textile-decitex fibers with an elastic stitching thread to cause the fibrous layer to become "gathered" between the stitches and rows of stitches. Preferably, the amount of gathering provides the resultant product with an area that is no more than 40% the original area of the fibrous layer. The large reduction in area is provided preferably by spandex yarns that are under sufficient tension to elongate 100 to 250% while stitching through the fibrous layer and then having the tension released after the stitching is completed. "Substantially nonbonded", with regard to the layer of textile decitex fibers, is said to mean that the fibers generally are not bonded to each other, by for example chemical or thermal action. However, a small amount of point bonding or line bonding is included in the term "substantially nonbonded", as long as the bonding is not sufficient to prevent the fibrous layer from contracting or gathering after having been stitched with the elastic thread. The resultant product is disclosed to be an excellent dust cloth and also suitable for use in thin insulative gloves, thermal underwear blankets and the like.

Although the above-described stitchbonded fabrics have performed satisfactorily in several end-uses, their utility as insulating fabrics could be enhanced greatly, especially if significant increases could be made in the specific volume of the fabrics and in their resistance to deterioration by repeated washing. Also, if the high elongations used with the favored elastic stitching yarns of the above-described processes could be avoided, more efficient and better control could be achieved in the stitch-bonding operation.

An object of the present invention is to provide an improved stitchbonded insulating fabric and a process for making it. Surprisingly, as described below, these purposes are achieved by stitchbonding a thin layer of bonded fibers in a way that reduces the area of the layer very little while significantly increasing the thickness of the layer, as compared to the earlier processes described above.

SUMMARY OF THE INVENTION

The present invention provides an improved stitchbonded fabric. As with known stitchbonded fabrics, the fabric of the invention has a nonwoven fibrous layer and spaced-apart rows of stitches with a row spacing in the range of 2 to 10 rows per centimeter formed by a yarn that amounts to 2 to 20 percent of the total weight of the fabric. The improvement of the present invention comprises the fibrous layer being composed of bonded fibers, each row of stitches having 1 to 5 stitches per centimeter, and the stitchbonded fabric having a specific volume of at least 16 cubic centimeters per gram and being extensible at least 8 percent and as much as 75%, in the direction of the rows of stitches. Preferred stitchbonded fabrics have a specific volume in the range of 20 to 25 $cm^3/g$ and an extensibility in the direction of the rows of stitches in the range of 20 to 40%. In another preferred embodiment, the stitchbonded fabric also has an extensibility in the direction transverse to the stitching in the range of 5 to 10%. Further preferred stitchbonded fabrics have the fibrous layer composed of bonded polyester fibers having a decitex in the range of 1 to 5. Insulation values for preferred stitchbonded fabrics of the invention are in the ranges of 0.3 to 0.5 CLO and of 2 to 3 CLO per $kg/m^2$.

The present invention, also provides an improved process for making the above-described stitchbonded fabric. The process is of the type in which a fibrous nonwoven layer is multi-needle stitched with an elastic thread under tension to form spaced-apart parallel rows of stitches, wherein needle spacing usually is in the range of 2 to 5 needles/cm, stitch spacing usually is in the range of 1 to 7 stitches/cm and the tension is released after the stitching. In the improved process of the present invention, the fibrous layer is composed of bonded fibers, preferably polyester of 1 to 5 dtex, the elastic yarn during stitching is under sufficient tension to stretch it in the range of 10 to 100%, preferably no more than 40%, and the thusly stitched nonwoven fabric, after release of the tension, is subjected to a shrinkage treatment that increases the specific volume of the fabric to at least 16 $cm^3$/gram, preferably to a value in the range of 20 to 25 $cm^3$/gram. It is further preferred that the shrinkage treatment be performed at a temperature in the range of 50° to 100° C.

DETAILED DESCRIPTION OF PREFERRED EMBODIMENTS

The invention is further illustrated by the following description of preferred embodiments. These are included for the purposes of illustration and are not intended to limit the scope of the invention, which is defined by the appended claims.

The starting fibrous layer that is to be stitchbonded in accordance with the present invention is usually a bonded nonwoven web of textile dtex fibers. Generally, for use in the fabrics and processes of the present invention, such bonded fibrous layers usually have a unit weight in the range of 25 to 150 g/m$^2$ and can be prepared, for example, from cross-lapped webs of carded fibers of textile dtex. The layer is usually provided wound up on a roll ready for feeding to the stitchbonding step. Usually, the bonded webs are composed of textile fibers made from synthetic polymers, such as polyester, nylon, acrylic, and the like. A particularly preferred fibrous layer is the 100-g/m$^2$ bonded web of Example 1 below, which is composed of a 75/25 mixture of 3.3 dtex polyethylene terephthalate fibers and polyethylene terephthalate/polyethylene isophthalate copolymer binder fibers. Other types of binders and bonding are suitable for use in preparing the starting fibrous layer for the process of the invention, such as thermoplastic particulate binders, solvent bonding, multipoint bonding and the like.

The stitching required for the fabric of the present invention can be performed with conventional multi-needle stitching equipment, such as "Liba", "Arachne" or "Mali" (including Malimo, Malipol and Maliwatt) machines. Such machines and some of the fabrics produced therewith are disclosed for example by K. W. Bahlo, "New Fabrics Without Weaving", Paper of the American Association for Textile Technology, Inc., pages 51–54 (November, 1965). Other disclosures of the use of such machines appear, for example in Ploch et al, U.S. Pat. No. 3,769,815, in Hughes, U.S. Pat. No. 3,649,428 and in Product Licensing Inex, Research Disclosure, "Stitchbonded products of continuous filament nonwoven webs", page 30 (June 1968). Generally, for fabrics of the present invention, 2 to 10 rows of stitches per centimeter (i.e., transverse to the machine direction, referred to herein as "TD" spacing) are satisfactory; 3 to 6 rows per cm are preferred. Stitch spacings of fewer than 5 stitches/cm (i.e., in the machine direction, referred to herein as "MD" spacing) generally are satisfactory; 1 to 2.5 stitches/cm are preferred. The stitching thread usually amounts to 2 to 20%, preferably less than 10%, of total weight of the fabric.

Substantially any thread that can elongate and retract between about 10 to 100% is suitable for use as the stitching thread for the fabric of the invention. However, preferred threads are those which at such elongations can provide a sufficient force to cause the bonded fibrous layer to contract or pucker. Such yarns, especially when used under preferred elongations in the range of 25 to 50% for the multi-needle stitching of the bonded fibrous layer, cause the layer to reduce somewhat in area but to significantly increase in thickness, thereby providing a more bulky or voluminous fabric. Conventional stretch yarns (e.g., spandex yarns) that can elongate and a contract, or yarns that can be made to shrink after stitching (e.g., heat or steam shrinkable yarns) can be used to form the required stitches. Also, the retractive force of the stitching can sometimes be provided by a mechanical pre-treatment of the yarn (e.g., stuffer-box crimped or other textured yarns) to impart latent form retractive forces that can be activated subsequent to the stitching.

Two particularly preferred stitching threads are illustrated in the Examples below. One is a wrapped spandex yarn, Type N-0493, and the other is a textured nylon yarn, Type N-3931, both of which are available commercially from Macfield Inc. of Madison, S.C. The stitching thread is multi-needle stitched into the bonded fibrous layer under tension in a stretched condition, so that when the tension is released, the retractive forces of the yarns cause the fibrous layer to contract and pucker. Preferred stitching yarns can elongate and retract in the range of 10 to 100 %, preferably 20 to 50%. As an alternative to providing all the retractive forces by inserting the yarn in an elongated condition, part or all of the retractive force can be supplied by shrinkage of the yarn. In the latter situation, the shrinkage can be activated, for example by heat, steam or a suitable chemical treatment, after the yarn has been stitched into the fibrous layer. The shrinkage activation can be accomplished during aqueous washing of the fabric, as illustrated in the examples below, preferably at a temperature in the range of 50° to 100° C., though dry heat and considerably higher temperatures also are sometimes suitable.

The preferred multi-needle stitching forms parallel series of zig-zag tricot stitches in the fibrous layer. Alternatively, the stitching can form parallel rows of chain stitches along the length of the fabric. Retraction or shrinkage of the stitching causes the area of the nonwoven fibrous layer to contract. When chain-stitching is employed, almost all of the contraction is in the "MD" (i.e., along the direction of the stitching). When tricot-stitching is employed the contraction occurs in the "TD" (i.e., transverse to the rows of stitches) as well as in the direction of the stitching. The rows of stitches are usually inserted by needles having a spacing in the range of 2 to 5 needles per cm and the stitches are inserted at a spacing in the range of 1 to 7 stitches per cm, preferably 2 to 5 stitches per cm. The completed stitchbonded fabric, after release of tension and the shrinkage step, usually has a unit weight in the range of 35 to 180 g/m$^2$, a thickness in the range of about 0.2 to 0.4 cm, and a specific volume of at least 16 cm$^3$/g, preferably in the range of 20 to 25 cm$^3$/g. Preferred fabrics of the invention exhibit a CLO in the range of 0.3 to 0.5, a CLO per kg/m$^2$ in the range of 2 to 3, an extensibility in the stitching direction of 20 to 40% and in the transverse direction of 5 to 10%.

Test Procedures

Various parameters and characteristics reported herein for fabrics of the invention and for comparison samples were measured by the following methods.

Fabric unit weight is measured according to ASTM D 3776-79 and is reported in grams per square meter. Fabric thickness is measured with a spring gauge having a 0.5-inch (1.2-cm) diameter cylindrical foot loaded with 10 grams. Specific volume, in cubic centimeters per gram is calculated from the measurement of unit weight and thickness.

Fabric percent extensibility is measured with an Instron Tensile Tester. A 4-inch-wide (10.15-cm-wide) sample is clamped between the jaws of the Instron Tester to provide a 2 inch (5.1 cm) jaw separation. A load, equivalent to 2 pounds per ounce/yd$^2$ of fabric (26 grams load per g/m$^2$), is applied to the fabric and the distance between the jaws, $L_e$, is measured. The load is then reduced to zero and the distance between the jaws, Lo, is measured. These measurements are made for samples cut in the MD and for samples cut in the XD. The percent extensibility in a given direction is then calculated by the formula, $$\% = [100(L_e - L_o)/L_o] - 100.$$

Insulating values for the fabrics of the invention are reported in terms of CLO, a unit of thermal resistance used in evaluating the warmth of clothing. A unit of CLO is the standard that was established to approximate the warmth of a wool business suit. However, CLO is defined in more precise technical terms as the thermal resistance which allows the passage of one kilogram calorie per square meter per hour with a temperature difference of 0.18° C. between two surfaces. Thus, 1 CLO=0.18 (°C.)($m^2$)(hr)/(kcal). The method of measuring CLO involves determining the thermal conductivity of a sample at the thickness obtained under a load of 0.002 psi (0.0138 kPa). The measurement is performed substantially as described in J. L. Cooper and M. J. Frankofsky, "Thermal Performance of Sleeping Bags", Journal of Coated Fabrics, Volume 10, page 110 (October 1980). The insulating value of the fabric is then reported in CLO and in CLO per unit weight (i.e., CLO/(kg/$m^2$).

EXAMPLES

The following examples illustrate the fabrics and process of the invention. The results reported in the examples are believed to be representative but do not constitute all the runs involving the indicated materials. In the Examples and their accompanying tables, the following abbreviations are employed:

MD stitches=number of stitches per cm in the "machine direction" (i.e., in stitching direction).

TD rows=number of rows per cm in the "transverse direction" (i.e., perpendicular to the stitching direction).

MD stretch=% extensibility in the machine direction

TD stretch=% extensibility in the transverse direction t=thickness of fabric in cm.

v=specific volume of fabric in $cm^3$/g.

A=flat area of fabric in $cm^2$.

subscript "o" refers to the value of t, A or v, before the shrinkage treatment, expressed as a % of the final t, A or v.

The Examples demonstrate the advantageous insulating and washability properties achieved by stitchbonding and shrinking bonded fibrous webs in accordance with the invention. In Examples 1–3, an elastomeric spandex yarn is employed as the multi-needle stitching yarn. In Examples 4–6, the yarn is a textured stretch nylon yarn. The fabrics of the invention are compared to stitchbonded webs prepared from the same fibrous layer by conventional techniques.

EXAMPLES 1–3

Three fabrics of the invention were prepared from a thermally bonded, carded polyester fiber web. The web weighed about 3 oz/$yd^2$ (102 g/$m^2$), was about 0.059-cm thick and was composed of about 75 parts by weight of 3 dpf (3.3 decitex) polyethylene terephthalte fibers (Type T-54 Dacron®) and about 25 parts of 3 dpf polyethylene terephthalate/isophthalate copolymer binder fibers (T-262 Dacron®). Both types of fibers had an average length of about 3 inches (7.6 cm) and were commercial staple fibers sold by E. I. du Pont de Nemours & Co.). The web was carded on a 100-inch wide Hergeth carding machine (manufactured by J. D. Hollingsworth of Greenville, S.C.) equipped with dual doffers and re-orienters and then thermally bonded with a Kusters bonder operating with a 100-psi (689-kPa) pressure and a roll of 150° C. at a speed of about 5 meters per minute. This bonded web was used as the starting fibrous layer for each of the samples of the examples of the invention and for each of the comparative examples described herein.

The bonded webs were multi-needle tricot stitched on a "Liba" stitch-bonding machine. For Examples 1–3, the stitching yarn was a 20-denier (22-dtex) shrinkable covered spandex yarn (Type N-0493 manufactured by Macfield Inc.), which was tensioned and stretched to 10 denier as it was stitched into the web. The MD stitch frequency was 11.5, 6 and 3 per inch (4.5, 2.4 or 1.2 per cm) as shown in the Table below, for Examples 1, 2 and 3 respectively. In all samples, the number of rows of stitches in the transverse direction was 12 per inch (4.8 per cm). The weight of elastomeric stitching amounted to about 2 percent of the total weight of the web in Examples 1–3.

For comparison purposes, another series of carded webs of the same weight and fiber blends as used for Examples 1–3 (but not thermally bonded) were prepared by lightly needling the carded webs on a Dilo Needler employing a needle density of 20 per square inch (3.1 per $cm^2$). The resultant webs, which were 0.225-inch (0.57-cm) thick, were then stitchbonded in the same manner as the web of Examples 1, 2 and 3 to form Comparison Samples A, B and C respectively. This method of preparation of the comparison samples is commonly used (but with non-stretch stitching yarns) in the preparation of conventional stitchbonded fabrics. Such conventional fabrics are often employed as insulating layers in apparel.

After stitchbonding, each sample of the invention and each comparison sample was relaxed and permitted to contract and then subjected to a further shrinkage treatment in which the sample was subjected to a wash-and-dry cycle in a home laundry machine. The cycle consisted of exposure to water at 140° F. (60° C.) for 5 minutes, followed by tumbling in air at 140° F. (60° C.) for 20 minutes. In Samples 1,2 and 3, the shrinkage treatment caused a modest reduction in the face area, a very large increase in the thickness and a large increase of at least 120% in fabric volume. In addition, the fabrics of the invention became stretchable, exhibiting an MD extensibility of 25 to 69% and a TD extensibility of 5 to 11%. In contrast, Comparison Samples A, B and C experienced no increase in thickness and became more dense (i.e., decreased in specific volume) and exhibited very little ability to stretch. Also, the CLO insulation values of the Samples 1, 2 and 3 of the invention were about twice as large as those of Comparison A, B and C respectively, and the CLO/(kg/$m^2$) were at least 1.5 times as great.

The durability of the Samples 1, 2 and 3 of the invention was demonstrated by subjecting the samples to repeated wash-and-dry cycles, as described in the preceding paragraph. Sample failure in this test was judged to have occurred when the sample exhibited small tears or pills on its surface. Note that each sample of the invention survived at least a dozen wash-dry cycles (Sample 1 survived 30 cycles), while Comparison Samples A, B and C survived no more than 5 cycles (Sample C did not even survive one cycle) The longest surviving samples of the invention had closest multi-needle stitch spacing.

The above-described results, along with other characteristics and properties of the fabrics of Samples 1, 2 and 3 of the invention and of Comparison Samples A, B and C, are summarized in Table I below.

TABLE I

| Fabrics Stitchbonded with Elastomeric Thread | Invention Samples | | | Comparison Samples | | |
|---|---|---|---|---|---|---|
| | 1 | 2 | 3 | A | B | C |
| Stitchbonded Fabric | | | | | | |
| MD stitches/cm | 4.5 | 2.0 | 1.2 | 4.5 | 2.4 | 1.2 |
| TD rows/cm | 4.7 | 4.7 | 4.7 | 4.7 | 4.7 | 4.7 |
| Yarn weight % | 2.0 | 2.0 | 2.0 | 3.2 | 2.9 | 3.2 |
| Thickness, cm | 0.076 | 0.076 | 0.081 | 0.145 | 0.130 | 0.147 |
| Shrunk Fabric | | | | | | |
| t, cm | 0.226 | 0.277 | 0.372 | 0.150 | 0.145 | 0.160 |
| v, $cm^3/g$ | 16.0 | 17.5 | 19.0 | 12.1 | 11 3 | 12.1 |
| % $A_o$ | 72 | 67 | 57 | 89 | 86 | 81 |
| % $t_o$ | 300 | 360 | 460 | 100 | 100 | 110 |
| % $v_o$ | 220 | 240 | 260 | 89 | 86 | 89 |
| % MD stretch | 25 | 39 | 67 | 11 | 16 | 22 |
| % TD stretch | 11 | 8 | 5 | 1 | 0 | 1 |
| Wash durability | | | | | | |
| cycles | 30 | 20 | 12 | 5 | 2 | 1 |
| Insulation | | | | | | |
| CLO | 0.340 | 0.380 | 0.450 | 0.178 | 0.202 | 0.207 |
| CLO/($kg/m^2$) | 2.36 | 2.48 | 2.48 | 1.50 | 1.62 | 1.59 |

EXAMPLES 4–6

Examples 1–3 were repeated except that the covered spandex stitching yarn was replaced with a stitching yarn that was a 20-dpf (22-dtex per filament) 10-filament, textured nylon stretch yarn (Type N-3931, sold by Macfield Inc.) to form Samples 4–6. Similarly, the preparation of Comparison Samples A, B and C was repeated with the Lycra® stitching thread being substituted for by the nylon stretch yarn to form Comparison Samples D, E and F. Characteristics and properties of the Samples 4, 5 and 6 of the invention and of Comparison Samples D, E and F, along with test results are summarized in Table II below.

TABLE II

| Fabrics Stitchbonded with Textured Nylon Thread | Invention Samples | | | Comparison Samples | | |
|---|---|---|---|---|---|---|
| | 4 | 5 | 6 | D | E | F |
| Stitchbonded fabric | | | | | | |
| MD stitches/cm | 4.5 | 2.0 | 1.2 | 4.5 | 2.4 | 1.2 |
| TD rows/cm | 4.7 | 4.7 | 4.7 | 4.7 | 4.7 | 4.7 |
| Yarn weight % | 6.8 | 6.8 | 7.7 | 11.2 | 10.7 | 11.7 |
| thickness, cm | 0.097 | 0.102 | 0.102 | 0.173 | 0.175 | 0.178 |
| Shrunk Fabric | | | | | | |
| t, cm | 0.216 | 0.267 | 0.356 | 0.162 | 0.170 | 0.188 |
| v, $cm^3/g$ | 17.4 | 19.3 | 23.0 | 13.0 | 14.0 | 14.1 |
| % $A_o$ | 90 | 79 | 71 | 97 | 93 | 85 |
| % $t_o$ | 220 | 260 | 350 | 90 | 100 | 110 |
| % $v_o$ | 200 | 210 | 250 | 87 | 93 | 94 |
| % MD stretch | 10 | 20 | 30 | 3 | 8 | 18 |
| % TD stretch | 1 | 5 | 0 | 0 | 0 | 0 |
| Wash durability | | | | | | |
| cycles | 25 | 20 | 15 | 5 | 3 | 2 |
| Insulation | | | | | | |
| CLO | nm | 0.360 | 0.410 | nm | nm | nm |
| CLO/($kg/m^2$) | nm | 2.60 | 2.77 | nm | nm | nm |

Note: "nm"means no measurement was made.

As in Examples 1–3, the results of Examples 4–6 again show the advantages of the samples of the invention over the comparison samples in specific volume, stretchability, wash durability, etc., albeit the advantage is not as quite as great as in Examples 1–3.

Fabrics of the invention have excellent insulation characteristics, not only opposite the Comparison fabrics of the examples, but also in comparison to typical commercial thermal fabrics. For example, one-or two-layer thermal underwear sold by Sears weighs about 5.3 oz/yd$^2$ (180 g/m2, has a CLO of about 0.24 and a CLO per kg/m2 of about 1.33. In comparison, Samples 1–6 of the invention weighed about 110 g/m$^2$, had CLO values in the range of 0.34 to 0.45 and CLO/(kg/m$^2$) in the range of 2.4 to 2.8. The insulating superiority of the fabrics of the invention is clearly evident.

In addition to the excellent insulating characteristics of the stitchbonded fabrics of the invention, the fabrics also possessed surprisingly good capacity for absorbing liquids. The fabrics were found to readily absorb (a) water amounting 15 times the weight of the fabric and (b) oil amounting to 12 times the weight of the fabric.

I claim:

1. An improved stitchbonded fabric having a nonwoven fibrous layer and spaced apart rows of stitches with a row spacing in the range of 2 to 10 rows per centimeter formed by a stitching yarn that amounts to 2 to 20 percent of the total weight of the fabric, the improvement comprising the fibrous layer being composed of bonded fibers, 10 the stitch spacing within each row being in the range of 1 to 7 stitches/cm and the fabric having a specific volume of at least 16 cubic centimeters per gram and an extensibility in the direction of the stitching in the range of 10 to 75%.

2. A stitchbonded fabric in accordance with claim 1 wherein the fibrous layer is composed of bonded polyester fibers, having a decitex in the range of 1 to 5, specific volume of the fabric is in the range of 20 to 25 $cm^3/g$ and the extensibility in the stitching direction is in the range of 20 to 40%.

3. A stitchbonded fabric in accordance with claim 2 having an insulation value of CLO in the range of 0.3 to 0.5 and of CLO per kg/m$^2$ in the range of 2 to 3.

4. A stitchbonded fabric in accordance with claim 1, 2 or 3 wherein the fabric has an extensibility in the direction transverse to the stitching in the range of 5 to 12%.

5. An improved process for preparing a stitchbonded fabric of claim 1 wherein a fibrous nonwoven layer is multi-needle stitched with an elastic thread under tension to form spaced-apart parallel rows of stitches, wherein the needle spacing is in the range of 2 to 5 needles/cm, the stitch spacing is in the range of 1 to 7 stitches/cm and then the tension is released, the improvement comprising the fibrous layer being composed of bonded fibers, the elastic yarn being under sufficient tension to stretch it 10 to 100% during the stitching operation, and the thusly stitchbonded nonwoven fabric, after release of the tension, being subjected to a shrinkage treatment that increases the specific volume of the fabric to at least 16 $cm^3$/gram.

6. A process in accordance with claim 5 wherein the elastic yarn is stretched to no more than 40% during the stitching, the fibrous web is composed of polyester fibers of 1 to 5 dtex, the shrinkage treatment is a heat treatment at a temperature in the range of 50° to 100° C. that increases the specific volume to a value in the range of 20 to 25 $cm^3/g$.

* * * * *

UNITED STATES PATENT OFFICE
CERTIFICATE OF CORRECTION

PATENT NO. : 4,876,128

DATED : October 24, 1989

INVENTOR(S) : Dimitri P. Zafiroglu

It is certified that error appears in the above-identified patent and that said Letters Patent is hereby corrected as shown below:

In the Claims:

In Claim 1, Column 8, Line 24, delete "10".

Signed and Sealed this

Seventeenth Day of September, 1991

*Attest:*

HARRY F. MANBECK, JR.

*Attesting Officer*

*Commissioner of Patents and Trademarks*